United States Patent [19]

Morse et al.

[11] Patent Number: 4,664,303

[45] Date of Patent: May 12, 1987

[54] SIMPLIFIED MOUNT FOR A WEB-SUPPORTING ROLLER

[75] Inventors: John E. Morse, Rochester; Michael W. LaCourt, Churchville; Richard G. Ellis, Macedon, all of N.Y.

[73] Assignee: Eastman Kodak Company, Rochester, N.Y.

[21] Appl. No.: 809,623

[22] Filed: Dec. 16, 1985

[51] Int. Cl.[4] ..... B65G 39/16; B65H 23/04

[52] U.S. Cl. ..... 226/21; 198/806; 226/23; 226/194

[58] Field of Search ..... 226/21, 23, 190, 191, 226/194, 15, 18; 242/57.1; 198/806, 840; 474/109, 122, 123; 29/169.7

[56] References Cited

U.S. PATENT DOCUMENTS

| | | | |
|---|---|---|---|
| 3,078,021 | 2/1963 | Crownfield et al. | 226/21 |
| 3,090,534 | 5/1963 | Frommer et al. | 226/21 |
| 3,269,626 | 8/1966 | Albrecht . | |
| 3,490,670 | 1/1970 | Carrell . | |
| 3,596,817 | 8/1971 | Morse et al. | 226/190 X |
| 3,986,650 | 10/1976 | Swanke . | |
| 4,027,966 | 6/1977 | Jordan . | |
| 4,055,922 | 11/1977 | Ellington et al. | 52/169.7 |
| 4,572,417 | 2/1986 | Joseph et al. | 226/21 X |

FOREIGN PATENT DOCUMENTS

| | | | |
|---|---|---|---|
| 412012 | 5/1974 | U.S.S.R. | 226/21 |

*Primary Examiner*—Stuart S. Levy
*Assistant Examiner*—Lynn M. Sohacki
*Attorney, Agent, or Firm*—Lawrence P. Kessler

[57] ABSTRACT

A web transport apparatus including a simplified mount for a web-supporting roller, providing the axis of such roller with two degrees of freedom of movement. The simplified roller mount comprises an elongated, substantially planar, flexure member having a stiffening rib located along its longitudinal axis to limit flex of the member to movement about its longitudinal axis. A pin is supported by the flexure member. The pin lies substantially in the plane of the flexure member with the longitudinal axis of the pin perpendicular to the longitudinal axis of the flexure member. The web-supporting roller is carried, for example by a yoke supported on the pin for movement with a first degree of freedom about the longitudinal axis of the pin and with a second degree of freedom about the longitudinal axis of the flexure member.

5 Claims, 7 Drawing Figures

SIMPLIFIED MOUNT FOR A WEB-SUPPORTING ROLLER

BACKGROUND OF INVENTION

This invention relates in general to a web transport apparatus including mounted rollers for supporting a web, and more particularly to a simplified mount for a web-supporting roller which provides the axis of such roller with two degrees of freedom of movement.

Transport of an elongated flexible web along a desired path is accomplished, for example by supporting the web at various locations with rollers. With an ideal web, perfectly cylindrical rollers, and accurate roller mounting and alignment with respect to the web and each other, the web will track without lateral deviation along its roller-defined transport path. However, in practice such conditions rarely occur. Thus the transported web tends to mistrack relative to its desired path; that is, it tends to shift laterally with respect to its support rollers.

Apparatus for correction of lateral (cross-track) shifting of roller-supported webs include crowned or flanged rollers, servo actuated steering rollers, or self-activated steering rollers. In certain instances where the web is fragile, such as a dielectric web for an electrographic reproduction apparatus, crowned or flanged rollers are not suitable for use in effecting such lateral shift correction. This is because such rollers may produce undesirable distortion or concentrated loading and local stresses in the web. While servo actuated steering rollers (e.g., see U.S. Pat. No. 4,027,966 issued July 7, 1977 in the name of Jordan) or self-activated steering rollers (e.g., see U.S. Pat. No. 3,596,817 issued Aug. 3, 1971 in the name of Morse et al) have been successfully employed for correction of lateral shifting of fragile webs, such apparatus require complicated and expensive structure for mounting the web-supporting rollers.

SUMMARY OF THE INVENTION

This invention is directed to a web transport apparatus including a simplified mount for a web-supporting roller, providing the axis of such roller with two degrees of freedom of movement. The simplified roller mount comprises an elongated, substantially planar, flexure member having a stiffening rib located along its longitudinal axis to limit flex of the member to movement about its longitudinal axis. A pin is supported by the flexure member. The pin lies substantially in the plane of the flexure member with the longitudinal axis of the pin perpendicular to the longitudinal axis of the flexure member. The web-supporting roller is carried, for example, by a yoke supported on the pin for movement with a first degree of freedom about the longitudinal axis of the pin and with a second degree of freedom about the longitudinal axis of the flexure member.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
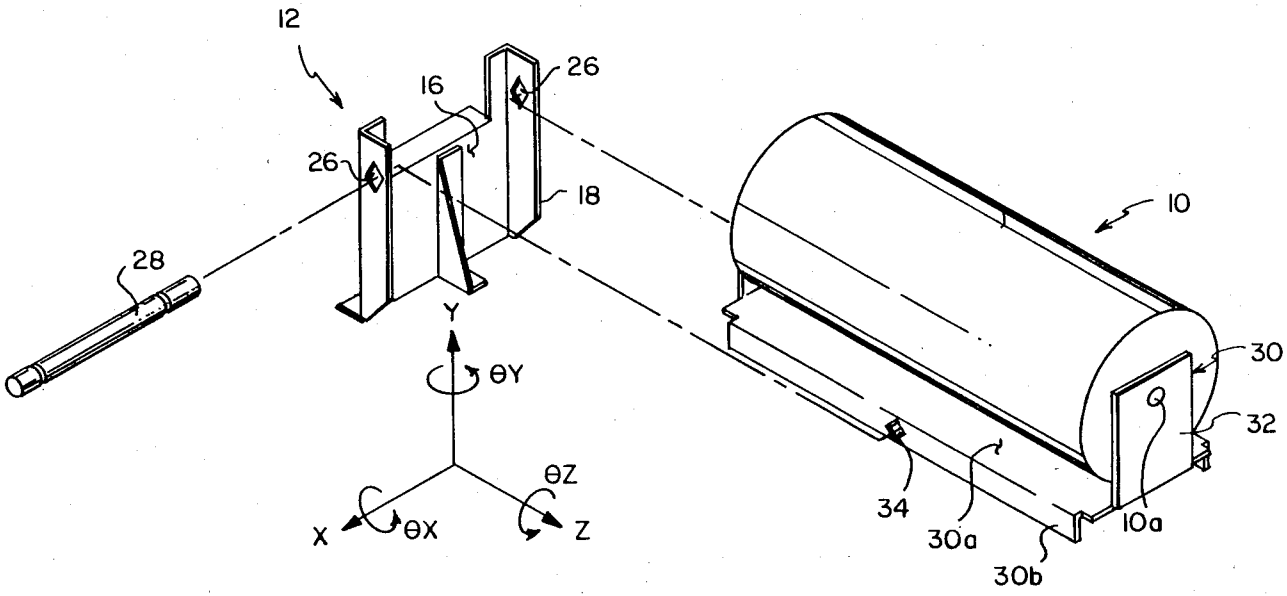
FIG. 1 is an exploded view, in perspective, of the web-supporting roller of a web transport apparatus and a simplified roller mount for such roller, according to this invention.
Figure 3:
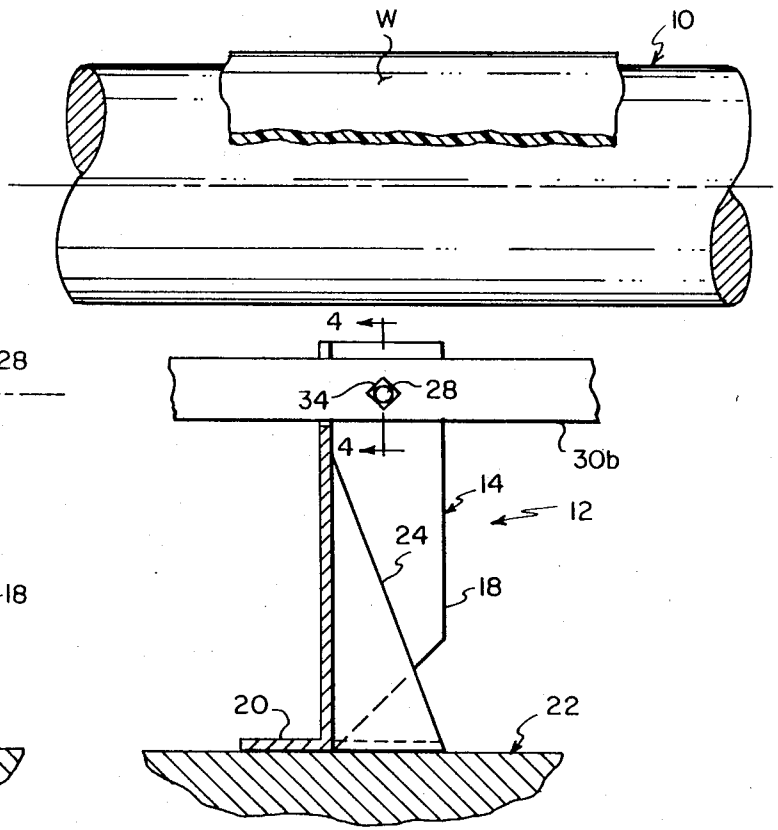
FIG. 3 is a side elevational view of a portion of the web-supporting roller and simplified roller mount according to this invention, in cross-section taken along lines 3—3 of FIG. 2.
Figure 2:
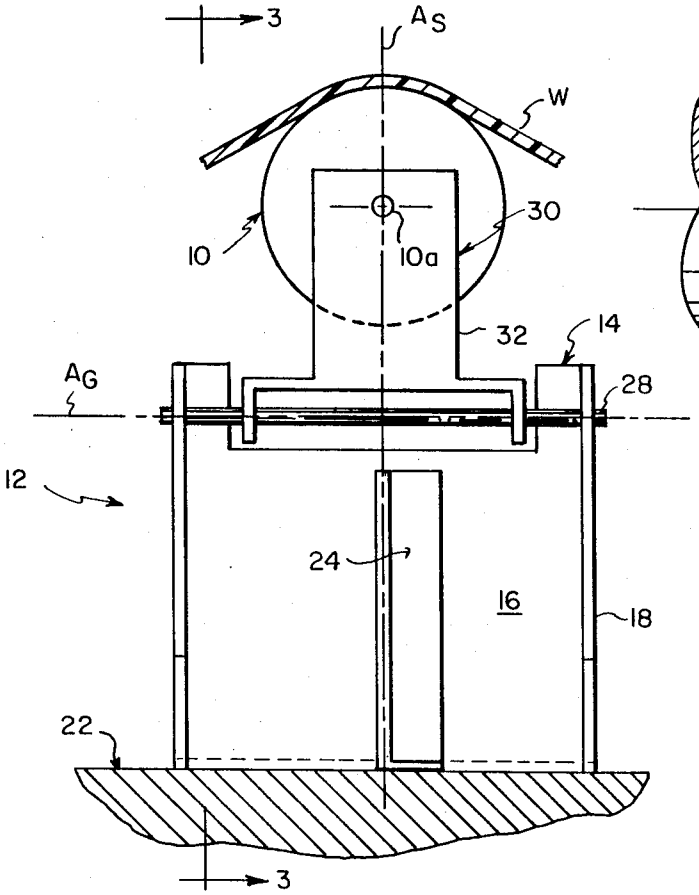
FIG. 2 is an end elevational view of structure of FIG. 1.

Referring now to the accompanying drawings, in a web transport apparatus, a roller 10 for supporting a moving web W is shown in FIGS. 1-3. The roller 10 is carried by a simplified roller mount 12 according to this invention. The roller mount 12, as will be more fully described hereinbelow, provides the axis of the roller with two degrees of freedom of movement. For example, the two degrees of freedom of movement for the axis of the roller 10 are: (1) about a gimbal axis $A_G$, and (2) about a steering axis $A_S$. Movement of the roller about such axes enables the roller 10 to be usefully employed in web transport apparatus such as shown and described in U.S. Pat. No. 3,540,571 (issued Nov. 17, 1970 in the name of Morse et al); U.S. Pat No. 3,913,813 (issued Oct. 25, 1975, in the name of Morse); or U.S. Pat. No. 3,974,952 (issued Aug. 17, 1976, in the name of Swanke et al).

The simplified roller mount 12 comprises an elongated flexure member 14 formed of a relatively flexible material, such as sheet metal for example. The member 14 has a substantially planar body 16 with opposed side flanges 18 and a base flange 20. The base flange 20 is fixed to a structural frame member 22. A flanged stiffening rib 24 is fixed to the flexure member 14 and the structural frame member 22. The stiffening rib 24 is aligned with the longitudinal axis of the flexure member and defines a steering axis $A_S$ for the web-supporting roller 10 when carried by the mount 12. The effect of the stiffening rib 24 is to limit the flexibility of the member 14 to rotational movement about its longitudinal axis (steering axis $A_S$).

The side flanges 18 of the flexure member 14 respectively have square-shaped openings 26. The openings, which are substantially aligned, are adapted to accommodate a pin 28. When the pin is located in the openings 26, its longitudinal axis defines a gimbal axis $A_G$ for the web-supporting roller 10 carried by the mount 12. While the gimbal axis $A_G$ is slightly offset relative to the plane of the body 16 of the flexure member 14, it can be effectively said to lie in such plane perpendicular to the steering axis $A_S$, with the steering axis $A_S$ intersecting the gimbal axis $A_G$ at approximately its mid-point.

The web-supporting roller 10 is carried by the mount 12 according to the following arrangement. The roller 10 includes stub shafts 10*a* extending from the ends thereof. The stub shafts are located coincident with the longitudinal axis of the roller. A yoke 30 has a body 30*a* and pair of upstanding brackets 32 located at opposed ends of the yoke body. The stub shafts 10*a* are supported respectively in the brackets 32 for free rotation in bearings (not shown) with the longitudinal axis of the roller 10 substantially parallel to the longitudinal axis of the yoke body 30*a*. The yoke body 30*a* also has a pair of marginal downturned flanges 30*b* perpendicular to the yoke body. The flanges 30*b* respectively have aligned square-shaped openings 34 adapted to accommodate the pin 28. The openings 34 are located such that a plane perpendicular to the yoke body 30*a* passing through the center of the openings intersects the longitudinal axis of the roller 10 at approximately its mid-point. When the openings 34 of flanges 30*b* and openings 26 of side flanges 18 are aligned, the pin 28 may be passed therethrough to support the roller-carrying yoke 30 relative to the mount 12.

Figure 4:
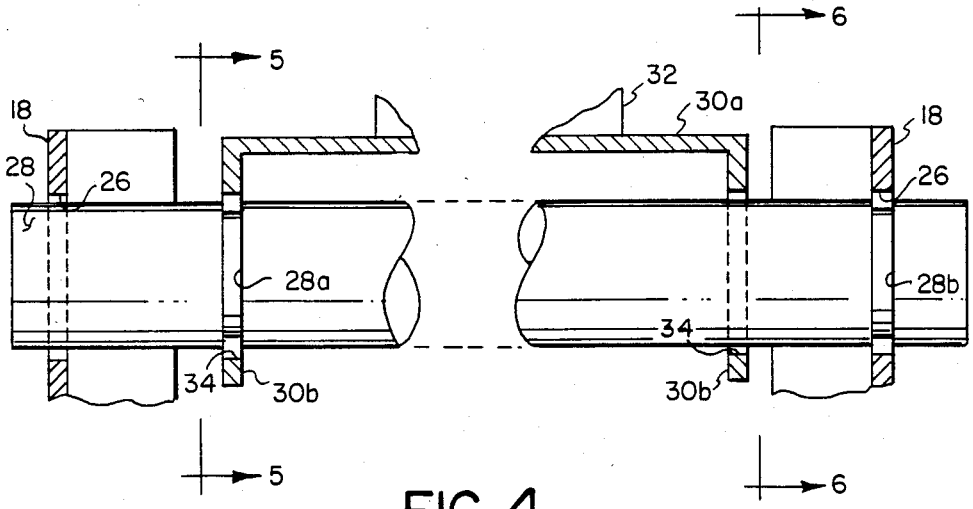
FIG. 4 is an end elevational view particularly showing the pin of the simplified roller mount, in cross-section taken along lines 4—4 of FIG. 3, with portions broken away to facilitate viewing.
Figure 5:
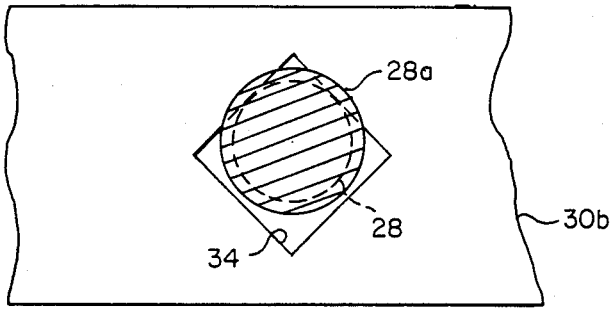
FIG. 5 is a side elevational view of the pin of the simplified roller mount, in cross-section taken along lines 5—5 of FIG. 4.
Figure 6:
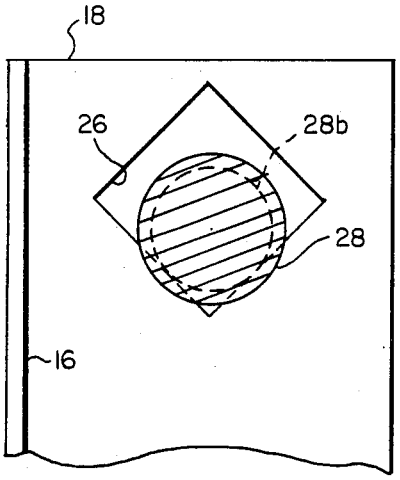
FIG. 6 is a side elevational view of the pin of the simplified roller mount, in cross-section taken along lines 6—6 of FIG. 4.

The pin 28 has a pair of circumferential grooves 28*a*, 28*b*. As shown in FIGS. 4–6, the grooves are spaced apart a distance such that, for example, groove 28*a* is engaged by adjacent surfaces of one of the openings 34, and groove 28*b* is engaged by adjacent surfaces of one of the openings 26. In this manner, the pin 28 is located so that the longitudinal axis of the flexure member 14 ($A_S$) lies in a plane intersecting the pin at approximately its mid-point and the longitudinal axis of the pin ($A_G$) lies in a plane intersecting the roller 10 at approximately its mid-point. Further, the pin 28 is thereby prevented from moving in the direction of its longitudinal axis relative to the flexure member 14, and the yoke 30 is prevented from moving relative to the pin in the direction of the longitudinal axis of the pin. Therefore, on assembly, the axis of the web-supporting roller 10 has two degrees of freedom of movement. That is to say, the axis of the roller 10 is movable with the yoke 30 about the gimbal axis $A_G$ defined by the pin 28, and about the steering axis $A_S$ defined by the stiffening rib 24 of the flexure member 14. Free movement of the axis of the roller 10 about such axes enables the roller to be usefully employed for web transport, as in the aforementioned patents.

Figure 7:
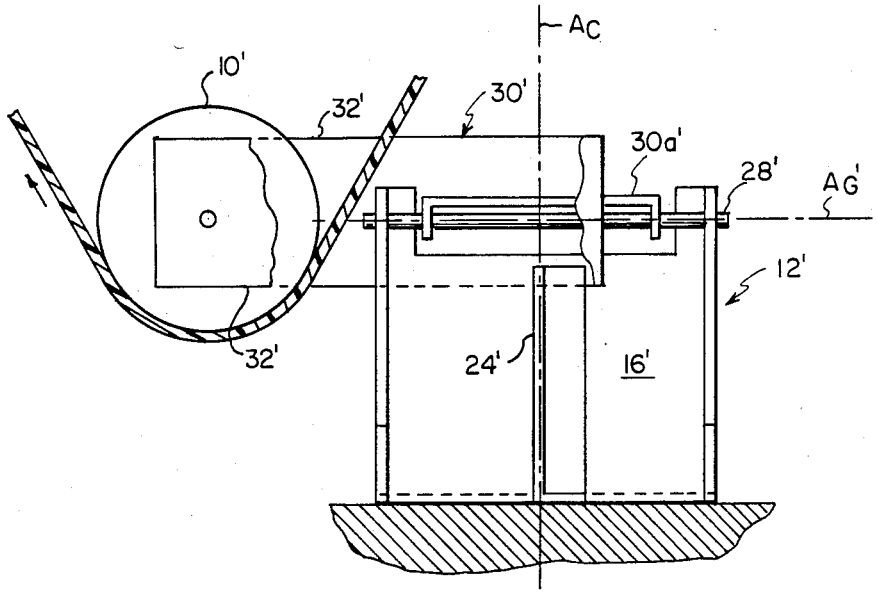
FIG. 7 is an end elevational view of an alternate embodiment for the web-supporting roller of a web transport apparatus and a simplified roller mount according to this invention.

An alternate embodiment of the simplified web-supporting roller mount according to this invention is shown in FIG. 7 and is designated generally by the numeral 12'. The simplified roller mount 12' is substantially identical in construction to the simplified roller mount 12, and has like elements designated with primed numerals. The difference between the embodiments stems from the construction of the roller-carrying yoke 30'. The brackets 32' of the yoke 30' extend from the yoke body 30*a*' in a direction oriented 90° from the brackets 32 of the yoke 30. As such the roller 10' is carried by the brackets 32' with its longitudinal axis lying in a first plane passing through the pin 28' and a second perpendicular plane parallel to and horizontally spaced from stiffening rib 24'. Therefore the pin 28' defines a gimbal axis $A_G'$, and the stiffening rib 24' of the flexure member 14' defines a caster axis $A_c$. The axis of the web-supporting roller 10' is thus similarly capable of movement with two degrees of freedom, but the axes about which such movement takes place are reversed with respect to provide a different useful function from the axes described with reference to roller 10 in FIGS. 1–6.

The invention has been described in detail with particular reference to preferred embodiments thereof, but it will be understood that variations and modifications can be effected within the spirit and scope of the invention.

We claim:

1. In a web transport apparatus including a simplified mount for a web-supporting roller providing the axis of such roller with two degrees of freedom of movement, said simplified roller mount comprising:

an elongated, substantially planar, flexure member having a stiffening rib located along the longitudinal axis of such member to limit flex of such member to movement about said longitudinal axis;

means, defined by said flexure member, for supporting a pin substantially in the plane of said member perpendicular to said longitudinal axis of said flexure member; and means for supporting a web-supporting roller on said pin for movement about said pin whereby the axis of said roller is moveable with two degrees of freedom about said pin and said longitudinal axis of said flexure member.

2. The invention of claim 1 wherein said longitudinal axis of said flexure member lies in a plane which intersects the longitudinal axis of said roller supported on said pin at the mid-point thereof.

3. The invention of claim 2 wherein said roller supporting means includes a yoke, said yoke being mounted on said pin at a location wherein the longitudinal axis of said roller mounted on said yoke and the longitudinal axis of said pin are perpendicular and lie in respective planes which intersect the mid-points of such roller and said pin.

4. The invention of claim 3 wherein said yoke orients the roller such that said longitudinal axis of said flexure member provides a steering axis for such roller, and said longitudinal axis of said pin provides a gimbal axis for such roller.

5. The invention of claim 3 wherein said yoke orients the roller such that said longitudinal axis of said flexure member provides a caster axis for such roller, and said longitudinal axis of said pin provides a gimbal axis for such roller.

* * * * *